US007891753B2

(12) United States Patent
Nishino

(10) Patent No.: US 7,891,753 B2
(45) Date of Patent: Feb. 22, 2011

(54) INKJET RECORDING APPARATUS

(75) Inventor: Satoshi Nishino, Sayama (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 713 days.

(21) Appl. No.: 11/886,085

(22) PCT Filed: Feb. 28, 2006

(86) PCT No.: PCT/JP2006/303672

§ 371 (c)(1),
(2), (4) Date: Sep. 11, 2007

(87) PCT Pub. No.: WO2006/098143

PCT Pub. Date: Sep. 21, 2006

(65) Prior Publication Data

US 2008/0211895 A1 Sep. 4, 2008

(30) Foreign Application Priority Data

Mar. 14, 2005 (JP) ..... 2005-071201

(51) Int. Cl.
*B41J 2/01* (2006.01)
*B41J 29/377* (2006.01)

(52) U.S. Cl. ..... 347/18; 347/102; 347/104; 347/223

(58) Field of Classification Search ..... 347/4, 347/18, 100–107, 223
See application file for complete search history.

(56) References Cited

U.S. PATENT DOCUMENTS 4,566,014 A * 1/1986 Paranjpe et al. ..... 346/25
4,774,523 A * 9/1988 Beaufort et al. ..... 346/25
6,550,905 B1 4/2003 Deckers
7,397,487 B2 * 7/2008 Fukui ..... 347/139
2001/0015746 A1 8/2001 Hisasi et al.

FOREIGN PATENT DOCUMENTS

JP 2004-114580 4/2004

OTHER PUBLICATIONS

European Search Report dated Apr. 9, 2008.

* cited by examiner

*Primary Examiner*—Daniel Petkovsek
(74) *Attorney, Agent, or Firm*—Finnegan, Henderson, Farabow, Garrett & Dunner, L.L.P.

(57) ABSTRACT

The present invention provides an inkjet recording apparatus, which performs high resolution image recording by inhibiting propagation of heat from a light-radiation device to a recording medium, is provided with a recording medium conveyance device to convey a recording medium in a conveyance direction; a recording head 10 to emit ink from a nozzle towards the recording medium; a first supporting member 5 to convey the recording medium so that the recording medium faces the recording head; a light radiation device 16 to radiate an activation energy ray towards the in emitted from the recording head; and a second support member 7 to convey the recording medium in a conveyance direction so that the recording medium faces the light radiation device; wherein between the first supporting member 5 and the second supporting member 7, in a recording medium conveyance direction, there are disposed a guide section 6 having a cooling device.

8 Claims, 1 Drawing Sheet

INKJET RECORDING APPARATUS

TECHNICAL FIELD PERTAINING TO THE INVENTION

The present invention relates to an ink jet recording apparatus, and in particular to an inkjet recording apparatus which emits ultraviolet ray curing ink so as to record an image.

BACKGROUND OF THE INVENTION

In recent years, there have been widely used ink jet recording apparatuses utilizing inkjet method as recording apparatuses capable of high resolution recording on various kinds of recording media. The inkjet recording apparatus has a recording head facing the recording medium and emits ink from a plurality of nozzles provided at the recording head to record the image while moving the recording head and recording medium relatively.

Also, it has been known that the image can be formed by using the ultraviolet curing ink on the recording medium having less ink absorbability such as a plastic film. Because the ultraviolet curing ink includes a photo initiator which has a certain sensitivity for ultraviolet ray, it is cured by irradiation of the ultraviolet ray from a light radiation device after landing on the recording medium, thereby printing can be easily carried out on transparent or non transparent packing medium and so forth.

In such ink jet recording apparatus, since the light radiation device is fixed, in case conveyance of the recording medium is stopped by a trouble such as occurrence of jamming, the ultraviolet ray is radiated at a particular area continuously, thereby there was a problem that the recording medium is deformed or discolored by heat from the light radiation device.

Therefore, as the Patent Document 1 discloses, there is a liner method inkjet recording apparatus in which the light radiation device moves relatively to the recording medium when the conveyance of the recording medium stops. In this inkjet recording apparatus, a position of the light radiation device is fixed for normal image recording so as to radiate the ultraviolet ray towards the recording medium. Also when the conveyance of the recording medium is stopped, the light radiation device is moved to a position at which the light radiation device does not face the conveyance device of the recording medium. In other words, when the conveyance of the recording medium is stopped by a trouble, the conveyance device of the recording medium is released from the light radiation device, thereby image forming can be carried out while preventing the particular area of the recording medium from continuous radiation of the ultraviolet.

Patent Document 1: Tokkai 2004-114580

DISCLOSURE OF THE INVENTION

Problems to be Solved by the Invention

In the inkjet recording apparatus of the Patent Document 1, the aforesaid adverse effect is prevented by moving the light radiation device to the position at which the light radiation device does not face the recording medium when the jamming of the recording medium occurs, however, while recording the image, the ultraviolet ray is continuously radiated without changing the position. Thus, in case image forming is continued for a long time, the heat generated by the light radiation device is propagated extensively and the conveyance device of the recording medium at upstream location of the light radiation device accumulate the heat. As the result, since a temperature distribution irregularity of the recording medium conveyed on a surface of the conveyance device occurs, a diameter of the ink dot landed varies, thus there was a problem that the recorded image is deteriorated by occurrence of uneven image and so forth.

The present invention has been achieved in view of the above problems. An object of the present invention is to provide an inkjet apparatus, which prevents extensive heat propagation to the recording medium conveyance device so as to be capable of high resolution image.

Means to Solve the Problems

To solve the problems, the inkjet recording apparatus of the present invention of claim 1 has: a recording medium conveyance device to convey a recording medium in a conveyance direction; an recording head to emit ink from a nozzle towards the recording medium; a first supporting member to support the recording medium so that the recording medium faces the recording head; a light radiation device to radiate an activation energy ray towards the recording medium; and a second support member to support the recording medium so that the recording medium faces the light radiation device; wherein the first supporting member and the second supporting member are arranged in a recording medium conveyance direction with a gap between the members thereof.

According to the invention of claim 1, the ink is emitted to the recording medium, which is supported by the first supporting member so as to be facing the recording head. Also, the recording medium is irradiated by the activation energy ray while being supported by the second supporting member so as to be facing the light radiation device. Here, the heat is generated on the second supporting member by irradiation of the activation energy ray from the light radiation device, however the first supporting member and second supporting member are installed with the gap between them, propagation of the heat generated at the second supporting member to the first supporting member is inhibited.

In the inkjet recording apparatus of claim 1, the invention described in claim 2 is an inkjet recording apparatus wherein the first supporting member and the second supporting member are platens to support the recording medium by its bottom surface respectively.

According to the inkjet recording apparatus of claim 2, since the first supporting member and the second supporting member are platens to support the recording medium by its bottom surface respectively, the recording apparatus is supported stably.

In the inkjet recording apparatus of claim 1, the invention described in claim 3 is an inkjet recording apparatus wherein the first supporting member and the second supporting member are loop-shaped conveyance belts to convey the recording medium while supporting the recording medium by its bottom surface.

According to the invention of claim 3, since the first supporting member and the second supporting member are loop-shaped conveyance belts which respectively support the recording medium by its bottom surface, they easily accumulate and propagate the generated heat to the recording medium. However, the first supporting member and second supporting member are arranged not to be in contact each other, propagation of the accumulated head to each other is effectively prevented even if either of the supporting members accumulate the heat. Therefore, the heat generated by the light radiation device can be propagated to the second supporting member but it is not propagated to the first supporting member as well.

In the inkjet recording apparatus of claim 3, the invention described in claim 4 is an inkjet recording apparatus wherein the first supporting member and the second supporting member are driven synchronously.

According to the invention of claim 4, since the first supporting member and the second supporting member are driven synchronously, a conveyance speed of each conveyance belt is substantially the same.

In the inkjet recording apparatus of claim 5 is an inkjet recording apparatus wherein the first supporting member and the second supporting member are arranged in sequence from upstream direction along the conveyance direction of the recording apparatus.

According to the invention of claim 5, the ink is emitted from the recording head to the recording medium while the recording medium is being conveyed through the conveyance belt of the first supporting member, then the ink is fixed by radiation of the activation energy ray from the light radiation member while the recording medium is being conveyed through the conveyance belt of the second supporting member. Here the first supporting member and second supporting member are arranged so as not to be in contact each other, and the ultraviolet ray is radiated after the ink is landed on the recording medium.

In the inkjet recording apparatus of claim 6 is an inkjet recording apparatus wherein there are provided a guide section between the first supporting member and the second supporting member so as to guide the recoding medium from the first supporting member to the second supporting member, and a cooling section to absorb and radiate the heat from the second supporting member at the guide section.

According to the invention of the claim 6, there is provided the guide section between the first supporting member and the second supporting member so as to guide the recoding medium from the first supporting member to the second supporting member, and a cooling section is provide at the guide section. Thus since the heat from the second supporting member is absorbed and radiated, propagation of the heat to the first supporting member is prevented. Also, the recording medium can be conveyed smoothly from the first supporting member to the second supporting member via guide section.

In the inkjet recording apparatus of claim 7 is an inkjet recording apparatus wherein the cooling section is installed at the second supporting device to absorb and radiate the heat from the second supporting device.

According to the invention of claim 7, the heat accumulated at the second supporting member is absorbed and radiated by the cooling section. Here, since the light radiation device is facing the second supporting member, the heat generated by radiation of the activation energy ray is propagated, however, amount of head accumulated at the second supporting member is reduced since the heat is absorbed and radiated by the cooling section.

In the inkjet recording apparatus of claim 8 is characterized in that the ink emitted from the nozzle has a viscosity of 10 to 50 mpa·s and a surface tension of 20 to 40 mN/m.

According to the invention of claim 8, the ink emitted from the nozzle has a viscosity of 10 to 50 mPa·s and a surface tension of 20 to 40 mN/m. Even with such ink having a high viscosity and an inferior wetability, high resolution image recording can be performed.

In the inkjet recording apparatus of claim 8 is characterized in that the ink emitted from the nozzle includes an activation energy ray curing compound, and the activation energy ray is an ultraviolet ray.

According to the invention of claim 8, the ink to be used includes the activation energy ray curing compound, and the activation energy ray is the ultraviolet ray. Thus, the ink can be cured effectively by radiating the ultraviolet ray.

ADVANTAGEOUS EFFECT OF THE INVENTION

According to the invention of claim 1, since the first supporting member and the second supporting member are installed so as not to be in contact each other, the heat from the light radiation device can not be propagated to the first support member, even if radiation of the activation energy ray is continued for a long time. Thus, the temperature distribution irregularity on the recording medium supported by the first supporting member can be inhibited, and high resolution image recording without an image irregularity can be performed.

According to the invention of claim 2, propagation of the heat from the first supporting member to the recording medium can be inhibited while the first supporting member and the second supporting member are supporting the recording medium stably. Thus, high resolution image recording without an image irregularity can be performed.

According to the invention of claim 3, the recording medium is conveyed stably though the conveyance belt of the first supporting member and the conveyance belt of the second supporting member, and the heat from the light radiation device is not propagated to the second supporting member during conveyance. Therefore, since the temperature distribution irregularity does not occur on the recording medium, high resolution image forming can be performed.

According to the invention of claim 4, since the conveyance belt of the first supporting member and the conveyance belt of the second supporting member convey the recording medium at substantially the same speed, a consecutive recording medium can be conveyed smoothly to perform image recording, and high resolution image recording can be performed without propagating the heat from the light radiation device to the recording medium.

According to the invention of claim 5, the first supporting member and the second supporting member are arranged so as not to be in contact each other, and the activation energy ray is radiated to the recording medium after the ink lands. Thus high resolution image recording can be performed without propagating the heat from the light radiation device to the recording medium.

According to the invention of claim 6, the recording medium is guided via the guide section from the first supporting member to the second supporting member, and the head from the second conveyance section is absorbed and radiated by the cooling device, thereby high resolution image recording can be performed without propagating the heat from the light radiation device to the recording medium.

According to the invention of claim 7, since accumulation of the heat at the second supporting member is reduced by providing the cooling section, propagation of the heat to the first supporting member is effectively inhibited and high resolution image recording can be performed.

According to the invention of claim 8, even with the ink having the high viscosity and the inferior wetability, the temperature distribution irregularity on the recording medium can be inhibited by preventing propagation of the heat from the light radiation device. Therefore, even in case such ink as ultraviolet curing ink having the high viscosity and the inferior wetability is used, high resolution image recording can be performed.

According to the invention of claim 8, since the ink to be used can be cured effectively by radiating the ultraviolet ray, high resolution image recording can be performed on a recording medium such as a plastic film having a low ink absorbability irrespective of the recording medium.

DESCRIPTION OF THE SYMBOLS

Figure 1:
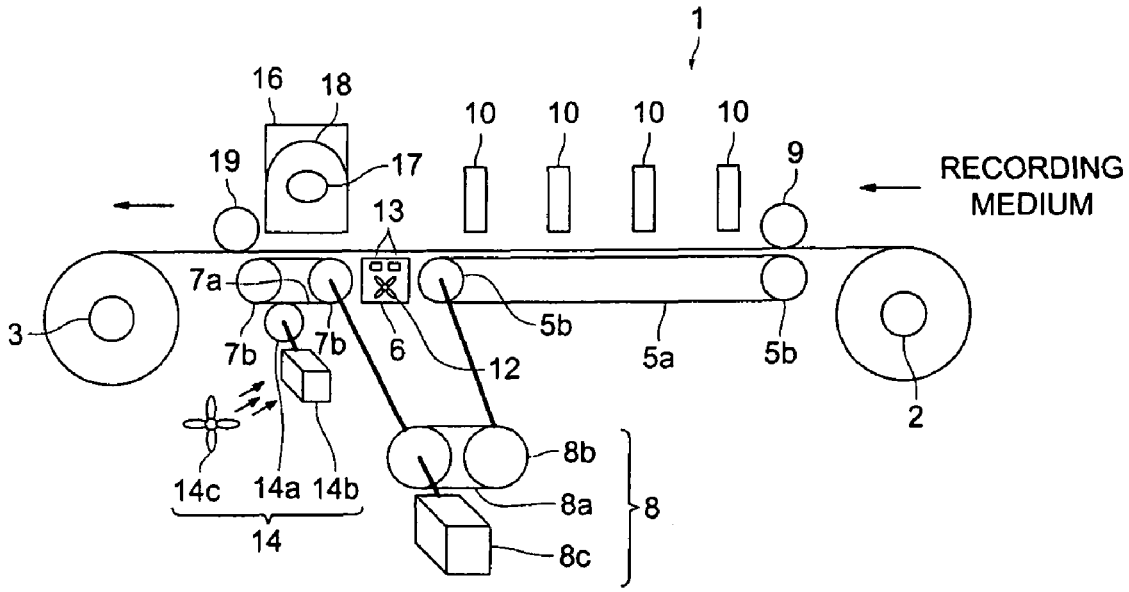
FIG. 1 is a side view of an inkjet recording apparatus of a first embodiment.

1 and 20: Inkjet recording apparatus
2: Feeding shaft
3: Rewinding shaft
5*a*: First conveyance belt (first supporting member)
5*b*: First conveyance roller
6: Guide section
7*a*: Second conveyance belt (second supporting member)
7*b*: Second conveyance roller
8: Conveyance drive section
9: Guide roller
10: Recording head
12: Fan
13: Ventilation opening
14: Cooling section
16: Light radiation device
17: Light source
18: Light source cover
19: Pinch roller
23: First supporting member
24: Second supporting member
25: Conveyance roller

PREFERRED EMBODIMENT OF THE INVENTION

The following describes the embodiments related to the present invention with reference to the drawings without the scope of the invention being restricted to the examples shown by the drawings.

FIG. 1 is a side view of an inkjet recording apparatus 1 of the present embodiment. The inkjet recording apparatus 1 is a liner method inkjet recording apparatus wherein at an upstream location in a conveyance direction (a direction of arrows in FIG. 1.), a feeding shaft 2, around which a long sheet of recording medium is wound and the trailing end of which is attached, is installed rotatably in a width direction of the recording medium; at a downstream location in the conveyance direction, a rewinding shaft 3, around which an leading end of the recording medium winds, is installed rotatably parallel to the feeding shaft 2; and an unillustrated rotation drive section including a rotation drive motor is connected to at least the rewinding shaft 3 so as to feed the recording medium from the feeding shaft 2 and to rewind the medium onto the rewind shaft 3.

Between the feeding shaft 2 and rewind shaft 3, and below the recording medium, there is installed a loop-shaped first conveyance belt 5*a* representing a first supporting member to convey and support the recording medium by its bottom surface. At an inner circumference of the first conveyance belt 5*a*, a pair of first conveyance rollers 5*b* and 5*b* are installed rotatably and longitudinally in the width direction of the recording media. The length of the first conveyance belt 5*a* and the first conveyance rollers 5*b* in the width direction is formed longer that the width of the recording medium so as to support the entire width of the recording medium. A conveyance drive section 8 is connected to at least either of the first conveyance rollers 5*b* to rotate the first conveyance rollers 5*b* in a predetermined speed.

A conveyance drive section 8 includes a loop-shaped drive belt 8*a*, a pair of drive rollers 8*b* which are installed inside the drive belt 8*a* and a drive motor 8*c* so as to drive and rotate one of the drive rollers 8*b*.

In a position above the recording medium and opposite to the first conveyance roller 5*b* at upstream location, a guide roller 9 is installed rotatably so as to guide the recording medium to a top of the first conveyance belt 5*a*. The guide roller 9 comes in contact with the recording medium by its own weight and rotates along with conveyance of the recording medium.

In a position above the recording medium and opposite to the first conveyance belt 5*a*, there are installed a plurality of recording heads 10 which emits ink towards the recording medium based on a predetermined image signal. Recording heads 10 are connected respectively with unillustrated ink tanks from which predetermined colors (yellow (Y), magenta (M), cyan (C) and black (K)) of ink are supplied. Also, the recording head 10 is installed along the width direction of the recording medium so as to oppose to the entire width of the recording medium. On a surface of the recording head 10 facing the recording medium, a plurality of nozzles to emit reserved ink are provided along the width direction of the recording medium. Here, recording head 10 can be arranged zigzag along the width direction of the recording medium to form a prolonged recording head.

The guide section 6 is provided below the recording medium at downstream location of the first conveyance belt 5*a* in the recording medium conveyance direction. The guide section 6 is formed in a shape of rectangular parallelepiped substantially and its upper surface is in contact with the bottom surface of the recording medium so as to guide the recording medium downstream in the conveyance direction. Also, in the guide section 6, a cooling device to absorb and radiate the heat propagated to the guide section 6 is provided. In the cooling device, a fan 12 to circulate air inside the guide section 6 and a ventilation opening 13 through which the air inside the guide section 6 and outside flows. To the fan 12, an unillustrated drive motor is connected, and the fan 12 is driven and rotated so as to circulate the air inside the guide section 6. Meanwhile, the cooling device for the guide section 6, is not limited to the fan 12, it can be substituted adequately.

At down stream side of the guide section 6 in the conveyance direction and below the recording medium, the second conveyance loop-shaped belt 7*a* is provided as the second supporting member to support and convey the recording medium by its bottom surface. In the same manner as the first conveyance belt 5*a*, the second conveyance belt 7*a* is in contact with the bottom surface of the recording medium so as to convey the recording medium in the conveyance direction. Inside the second conveyance belt 7*a*, a pair of second conveyance rollers 7*b* and 7*b* to convey the second conveyance belt 7*a* are provided rotatably. A conveyance drive section 8 to rotate and drive the second conveyance roller 7*b* at the same speed as the first conveyance roller 5*b* is connected to at least either of the second conveyance rollers 7*b*.

Specifically, to the second conveyance roller 7*b*, one drive roller 8*b* is connected and to the first conveyance roller 5*b*, the other drive roller 8*b* is connected. Therefore, the conveyance drive section 8 rotates and drives one drive roller 8*b* by the driving motor 8*c*, thereby the other drive roller 8*b* is rotated along with conveyance of the drive belt 8*a*. At that time, the first conveyance roller 5*b* and the second conveyance roller 7*b* connected to each drive roller 8*b* rotate at the same circumferential speed. Thus, the first conveyance belt 5*a* and the second conveyance belt 7*a* are associated synchronously so that each conveyance speed becomes equal.

Below the second conveyance belt 7*a*, a cooling section 14 to absorb and radiate the heat propagated to the second conveyance belt 7*a* is provided. The cooling section 14 includes a steel cooling roller 14*a* which rotates and follows conveyance of the second conveyance belt 7*a*, being in contact with the second conveyance belt 7*a*, a heat sink section 14*b* to which the heat is propagated from the cooling roller 14*a*, and a fan 14*c* which sends air to the heat sink section 14*b* to cool it. Also, a length of the cooling roller 14*a* is substantially the same as a width of the second conveyance belt 7*a* so as to contact the entire width of the second conveyance belt 7*a*. Meanwhile, the cooling section 14 can be any device if it can cool the second supporting member, and can be substituted adequately in the same manner as the aforesaid cooling device.

In a position above the recording medium and opposite to the second conveyance belt 7*a*, a light radiation device to radiate the ultraviolet ray representing the activation energy ray to the ink emitted from the recording head 10 and landed on the recording medium. The light radiation device 16 is provided with a light source 17 to radiate the light having a wavelength range of ultraviolet ray. Above the light source 17, a light source cover 18 is provided so as to reflect and radiate the ultraviolet ray from the light source 17 onto the recording medium.

Above the recording medium and at a downstream location of the light radiation device in the conveyance direction of the recording medium, a pinch roller is provided rotatably to hold down the recording medium, inhibiting it from lifting. The same manner as the guide roller, pinch roller 19 is in contact with the recording medium by its own weight and rotates along with conveyance of the recording medium.

Here, as the recording medium to be used in the present embodiment, various kinds of paper such as ordinary paper, recycle paper, synthetic paper and gloss paper, various kinds of textiles, various kinds of nonwoven cloths, resin, steel and glass are applicable. Further, as the recording medium to be used in the present embodiment, publicly known recording media such as various kinds of paper, which surfaces are coated by resins, films including pigments and foaming films are applicable. Here, in case a non continuing shape recording medium such as a cutting sheet is used, a medium conveyance device to convey the recording medium in the conveyance direction is provided above the first supporting member and the second supporting member, instead of the recording medium conveyance mechanism such as the feeding shaft 2 and rewinding shaft 3.

Also, the following describes the ink used in the present embodiment. When the ink is cured, a polymerizable compound included in the ink is polymerized. In the present invention, the ink used for image recording includes an activation energy curing compound as the polymerizable compound, and is an ultraviolet ray curing ink wherein ultraviolet ray is used as the activating energy to initiate the polymerization reaction.

The ultraviolet ray curable ink is divided broadly into radical curable ink which includes a radical polymerizable compound as the polymerizable compound and cation curable ink which includes a cation polymerizable compound. Either kinds of ink are applicable for the present embodiment and hybrid ink where the radical curable ink and the cation curable ink are combined can be used for the present embodiment.

However, since the cation curable ink having less or no inhibition by oxygen for polymerization reaction is superior in functionality and versatility, the cation curable ink is used for the present embodiment. Specifically, the cation ink used in the present embodiment is a mixture includes at least; the cation polymerizable compounds such as an oxetane compound, an epoxy compound and a vinylether compound; a photo cation initiator; and a pigment provided with a curable characteristic by irradiation of the ultraviolet ray.

Also, the ink used in the present embodiment is liquid having a viscosity of 10 to 50 mPa·s and a surface tension of 20 to 40 mN/m, which is so-called the ink with a high viscosity and an inferior wetability. However, there is no possibility of breeding on the recording medium due to excessive low ink viscosity and deterioration of flatness due to excessive high viscosity. Also, within the range of the aforesaid surface tension, the ink landed on the recording medium can spread adequately, thus image recording with a high resolution and sharpness can be realized.

Next, the following describes the operation of the present embodiment.

Firstly, when a leading end of the recording medium is wound by a rewind shaft 3, a rotation drive section rotates the rewinding shaft 3 to feed the recording medium from a feeding shaft 2 while winding the recording medium. The recording medium fed from the feeding shaft 2 is conveyed downstream sequentially in a conveyance direction.

A conveyance drive section 8 rotates one of drive rollers 8*b* by a drive motor 8*c* at a predetermined speed. Then the other drive roller 8*b* is also rotated along with conveyance of a drive belt 8*b*. At this stage, since a first conveyance roller 5*b* connected to the drive roller 8*b* and the second conveyance roller 7*b* are rotated at a predetermined circumferential speed, a first conveyance belt 5*a* and a second conveyance belt 7*a* are conveyed at the same speed. Therefore, the recording medium is conveyed through the first conveyance belt 5*a* and the second conveyance belt 7*a* stably. Also, though a gap is provided so that the first conveyance belt and the second conveyance belt do not come in contact each other, a guide section 6 is provided in the gap to guide the recording medium. Thus conveyance is smoothly carried.

When the recording medium is conveyed, a recording head 10 emits ink from nozzles based on an inputted image signal. Then the ink lands on the recording medium and the recording medium is conveyed downstream in the conveyance direction. A light radiation device 16 is provided at downstream location of the recording head 10. While conveying the recording medium, a light source 17 turns on to radiate the ultraviolet ray towards the recording medium. Thereby the ink landed on the recording medium is cured by radiation of the ultraviolet ray from the light radiation device 16. As above, ink is fixed onto the recording medium to perform image recording.

The recording area of recording media on which image recording is performed, is further conveyed downstream in the conveyance direction. A pinch roller 19 provided at downstream location in the conveyance direction comes in contact with the recording medium conveyed and also guides the recording medium to the rewinding shaft 3. Thereby, the recording medium is sequentially wound onto the rewinding shaft 3.

Here, while the recording medium is being conveyed, the light radiation device 16 continuously turn on the light source 17 so that the ultraviolet ray is continuously radiated. However, since the second conveyance belt 7*a* is provided with the cooling section 14, an amount of the heat exceeding a predetermined value cannot be accumulated. Also, the gap is provided between the first conveyance belt 5*a* and the second conveyance belt 7*a* so that they do not come in contact each other, and the guide section 6 is provided in the gap. Thus the heat from the light source propagated to the second conveyance belt 7*a* is not propagated to the first conveyance belt 5*a*. Here, the guide section is provided with a cooling device where a fan 12 is driven and rotated to circulate air inside the guide section 6 and to bring in air outside through the ventilation opening 13. Thus though the heat is propagated from the second conveyance belt 7*a* to the guide section 6, the cooling device absorbs and radiates the heat so as to prevent the first conveyance belt 5*a* form propagation of the heat.

As above, according to the present embodiment, even if the heat due to radiation of the ultraviolet ray from the light source 17 is propagated to the second conveyance belt 7*a*, the cooling section 14 absorbs and radiates the heat at the second conveyance belt 7*a*. Also, even if the heat due to radiation of the ultraviolet ray is propagated from the second conveyance belt 7*a* to the guide section 6, a cooling device absorbs and radiates the heat at the guide section 6. Therefore, the heat due to radiation of the ultraviolet ray from the light source 17 cannot be propagated to the first conveyance belt 5*a*, thus a temperature distribution irregularity of the recording medium convey on the surface of the first conveyance belt 5*a* can be inhibited and image recording with the high resolution can be performed without having image irregularity.

Meanwhile, in the present embodiment, while the first supporting member and the second supporting member are respectively configured with the conveyance belts, they can be altered adequately. For example, the recording medium can be conveyed by rotation of the rewinding shaft 3, and platens can be used as the first supporting member and the second supporting member to support the recording medium.

A Second Embodiment

Figure 2:
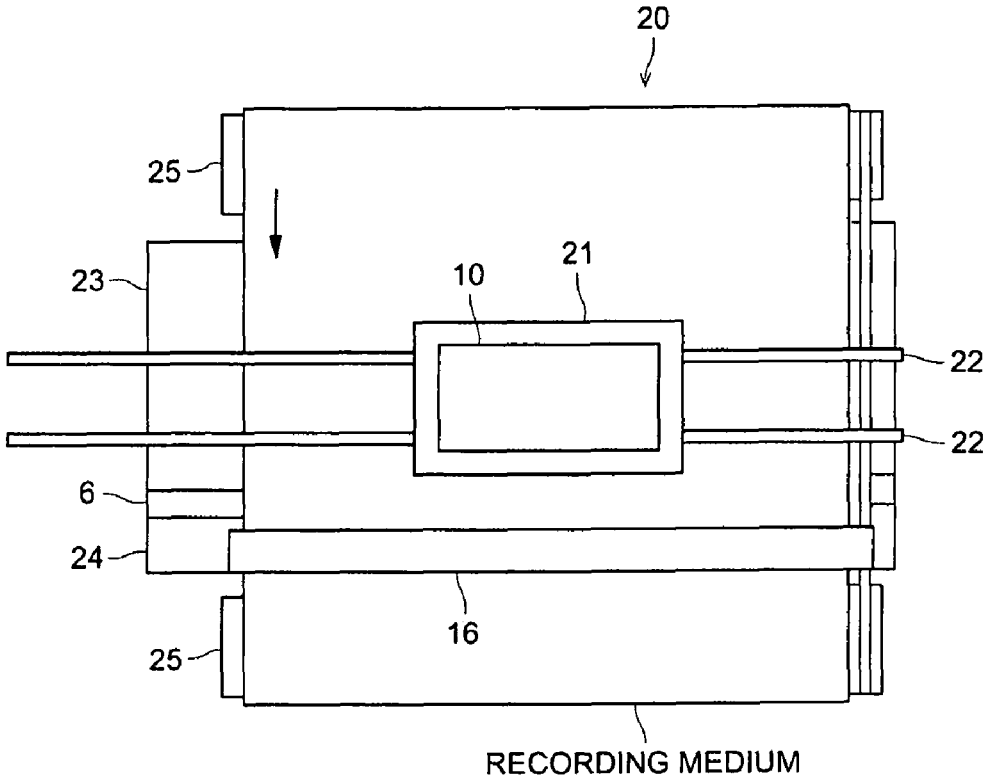
FIG. 2 is a plane view of an inkjet recording apparatus of a second embodiment.

The inkjet recording apparatus 1 of the first embodiment is the liner method inkjet recording apparatus. However, the present invention can be applied to a serial method inkjet recording apparatus 20 where the light radiation device is fixed as FIG. 2 shows.

The inkjet recording apparatus 20 differs from the inkjet apparatus 1 of the first embodiment in an aspect that the recording head 10 reciprocates above the recording medium to emit ink without covering the entire width of the recording medium. In this case, the recording head 10 is mounted at a carriage 21 and the carriage 21 reciprocates along guide rails 22 and 22 which is longitudinally disposed in the with direction of the recording medium. Also, the recording medium is long in the length and its leading and trailing ends are wound by conveyance rollers 25 representing conveyance devices. Thus the recording medium is fed intermittently by rotating the conveyance rollers 25 at downstream location in the conveyance direction. Then, the recording medium is supported by a first supporting member 23, a guide section 6 and a second supporting member below the recording head 10 and the light radiation device 16. Each of the first supporting member 23 and the second supporting member 24 is a platen in a shape of a flat board, which supports the recording medium by its bottom surface. Also, the guide 6 has the same structure as that of the first embodiment so as to guide the recording medium from the first supporting member to the second supporting member.

In the inkjet recording apparatus 20 having such structure, when the image recording area of the recording medium is conveyed to the upper area of the first supporting member 23, the conveyance is ceased once then ink is emitted from the recording head 10 on the upper area while the carriage 21 is reciprocating. After the ink is landed onto the image recording area of the recording medium, the recording medium is conveyed again and the image recording area is conveyed to the upper area of the second supporting member 24 through a surface of the guide section 6. Then the ultraviolet ray is radiated from the light radiation device 16 to fix the ink on the image recording area. Thereafter, the recording medium is conveyed again so as to complete image recording on the image recording area.

According the inkjet recording apparatus 20 having such structure, in the serial method inkjet recording apparatus 20, propagation of the heat from the light radiation device 16 can be prevented and the first supporting member 23 and second supporting member 24 can support the recording medium stably. Therefore, since extensive propagation of the heat from the light radiation device 16 can be inhibited effectively while the recording medium is being conveyed stable, high resolution image recording can be performed without image irregularity.

What is claimed is:

1. An inkjet recording apparatus, comprising:

a recording medium conveyance device to convey a recording medium in a conveyance direction;

a recording head to emit ink from a nozzle towards the recording medium;

a first supporting member to support the recording medium so that the recording medium faces the recording head;

a light radiation device to radiate an activation energy ray towards the recording medium;

a second supporting member to support the recording medium so that the recording medium faces the light radiation device; and a cooling section provided in a gap between the first supporting member and the second supporting member in the recording medium conveyance direction to absorb and radiate heat from the second supporting member and to prevent the heat from propagating to the first supporting member.

2. The inkjet recording apparatus of claim 1, wherein the first supporting member and the second supporting member are platens to support the recording medium by its bottom surface respectively.

3. The inkjet recording apparatus of claim 1, wherein the first supporting member and the second supporting member are loop-shaped conveyance belts to convey the recording medium while supporting the recording medium by its bottom surface.

4. The inkjet recording apparatus of claim 3, wherein the first supporting member and the second supporting member are driven synchronously.

5. The inkjet recording apparatus of claim 1, wherein the first supporting member and the second supporting member are arranged in sequence from an upstream direction along the conveyance direction of the recording medium.

6. The inkjet recording apparatus of claim 1, further including another cooling section provided at the second supporting member to absorb and radiate the heat from the second supporting member.

7. The inkjet recording apparatus of claims 1, wherein the ink emitted from the nozzle has a viscosity of 10 to 50 mPa·s and a surface tension of 20 to 40 mN/m.

8. The inkjet recording apparatus of claim 1, wherein the ink emitted from the nozzle includes an activation energy ray curing compound, and the activation energy ray is an ultraviolet ray.

* * * * *